US007380548B2

(12) United States Patent
Ryan et al.

(10) Patent No.: US 7,380,548 B2
(45) Date of Patent: Jun. 3, 2008

(54) STOVE APPARATUS

(75) Inventors: Kenneth F. Ryan, Weymouth, MA (US); Robert DiLalla, Worcester, MA (US); Anthony Cellucci, Norwood, MA (US); Louis Jamieson, Warwick, RI (US); Shubham Chandra, Framingham, MA (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 12 days.

(21) Appl. No.: 11/268,416

(22) Filed: Nov. 3, 2005

(65) Prior Publication Data

US 2007/0095338 A1 May 3, 2007

(51) Int. Cl.
*F24B 1/189* (2006.01)

(52) U.S. Cl. ..... 126/25 R; 126/9 R; 126/83; 99/401

(58) Field of Classification Search ..... 126/25 R, 126/29, 9 R, 39 R, 83; 99/425, 446, 401
See application file for complete search history.

(56) References Cited

U.S. PATENT DOCUMENTS 4,434,781 A * 3/1984 Koziol ..... 126/25 R
5,445,137 A * 8/1995 Crews ..... 126/59
5,676,043 A * 10/1997 Best ..... 126/39 B
6,041,769 A * 3/2000 Llodra et al. ..... 126/41 R
6,095,130 A * 8/2000 Faraj ..... 126/25 R
6,205,995 B1 * 3/2001 Odenwald ..... 126/38
6,389,960 B1 5/2002 Williams
6,422,231 B1 7/2002 Hamilton et al.
6,557,546 B1 * 5/2003 Gibbons ..... 126/41 R
6,913,458 B2 7/2005 Mosher et al.

* cited by examiner

*Primary Examiner*—Steve McAllister
*Assistant Examiner*—Sarah Suereth
(74) *Attorney, Agent, or Firm*—Vincent J. Ranucci

(57) ABSTRACT

A stove comprising a frame bounding an area to receive a burner, a heating cavity assembly mounted on the frame and having four side walls and a bottom wall having an opening therein, and a collar mounted in the heating cavity assembly around the opening. Front, rear, and side panels are mounted on the frame to enclose the side walls of the heating cavity assembly. A diffuser plate is mounted on the heating cavity assembly and covers an open top portion thereof, the diffuser plate being configured to receive heated gases rising from the burner and collar, and to distribute the heated gases evenly proximate an upper surface of the diffuser plate. A griddle plate is mounted above the diffuser plate and spaced therefrom, an undersurface of the griddle plate being opposed to the diffuser plate upper surface. The griddle plate provides an upper surface for cooking operations.

17 Claims, 15 Drawing Sheets

STOVE APPARATUS

STATEMENT OF GOVERNMENT INTEREST

The invention described herein may be manufactured and used by the U.S. Government for governmental purposes without the payment of any royalty thereon.

BACKGROUND OF THE INVENTION

1. Field of the Invention

The invention relates to a stove apparatus, and is directed more particularly to such an apparatus as is suitable for cooking meals for large numbers of people in remote areas or field conditions, as in the case of feeding soldiers, relief workers, people displaced by war or climatic event, and the like.

2. Description of the Prior Art

It is known to provide cooking devices for use in areas in which permanent cooking facilities are not available. Meals must be prepared for soldiers in the field, displaced persons, campers, victims of storms, and for recreational environments, large gatherings at entertainment sites, and numerous others.

The devices provided in the art range from basic "back yard" barbecues to fairly sophisticated cooking assemblies.

Some shortcomings of such devices include the lack of an evenly heated cooking surface. Typically, the cooking surface, or griddle plate, is well heated in a central portion thereof and less heated outwardly from the central portion.

Further, after an extended period of cooking, many of the stoves in use produce an uncomfortably high ambient temperature around the stoves, causing the cook to have to often step back from the stove for a period in cooler, fresher, air.

Still further, after a period of use, many stoves become hot throughout, such that even parts thereof, such as handrails, intended to facilitate grasping and moving parts of the stove, or the stove itself, become too hot to handle without heavy gloves.

Still further, the accumulation of grease and the sputtering thereof can occasion burns on the cook and splatter onto clothes or skin surfaces of near by-standers.

Still further, cooking devices of this type usually are made with built-in fuel support and burning means; there is typically no way to change fuels or types of burners, or the like.

Still further, most stoves of this type have no facility for selectively regulating the heat generated by burning fuel, other than manually increasing or decreasing the amount of fuel being burned.

Finally, in stoves of that type in which metal plates or other pieces join edge-to-edge, an extended period of heating can cause expansion of such pieces, such that they are jammed together, and separation thereof either requires a cooling off period or the dangerous handling of hot components.

Accordingly, there remains room for improvement in many areas of stove construction.

SUMMARY OF THE INVENTION

An object of the invention is, therefore, to provide an improved stove apparatus suitable for field use and improving upon or eliminating the above-noted common problems.

With the above and other objects in view, as will hereinafter appear, a feature of the present invention is the provision of a stove apparatus including a frame assembly bounding an area at a base thereof adapted to receive a burner assembly including a burner for supporting a flame, a heating cavity assembly mounted on the frame assembly and having four side walls, and a bottom wall having an opening therein, a collar structure mounted in the heating cavity assembly around the bottom wall opening and upstanding from the bottom wall, front, rear, first and second side panels mounted on the frame assembly to enclose the side walls of the heating cavity assembly, a diffuser plate mounted on the heating cavity assembly and covering an otherwise open top portion thereof, the diffuser plate being configured to receive heated gases rising from the burner and through the collar structure, and to distribute the heated gases substantially evenly proximate an upper surface of the diffuser plate, and a griddle plate mounted above the diffuser plate and spaced therefrom, and having an undersurface opposed to the diffuser plate upper surface, and having an upper surface for cooking operations.

In accordance with a further feature of the invention, there is provided a stove apparatus including a frame bounding an area at a base thereof adapted to receive a burner assembly including a burner for supporting a flame, a heating cavity sleeve mounted on the frame and having four side walls and a bottom wall, and having an opening in the bottom wall thereof, a top portion of the heating cavity sleeve being open, a heating cavity member shaped substantially complementarily to the heating cavity sleeve for disposition in the heating cavity sleeve, the heating cavity member having four side walls and a bottom wall and having an opening aligned with the heating cavity sleeve opening and having an open top portion bounded by an outwardly extending flange, a heating cavity collar structure disposed in the heating cavity member around the heating cavity opening and upstanding from a bottom wall of the heating cavity member, front, rear and first and second side panels mounted on the frame around the heating cavity member to enclose all sides of the heating cavity member, a diffuser plate mounted on the heating cavity member so as to cover the heating cavity member open top portion, the diffuser plate being configured to receive heated gases rising from the burner and through the heating cavity collar structure, and to distribute the heated gases substantially evenly proximate an upper surface of the diffuser plate, and a griddle plate mounted above the diffuser plate and having an undersurface opposed to the diffuser plate upper surface and having an upper surface for cooking operations.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent.

In the drawings.

DESCRIPTION OF THE PREFERRED EMBODIMENTS

Figure 1:
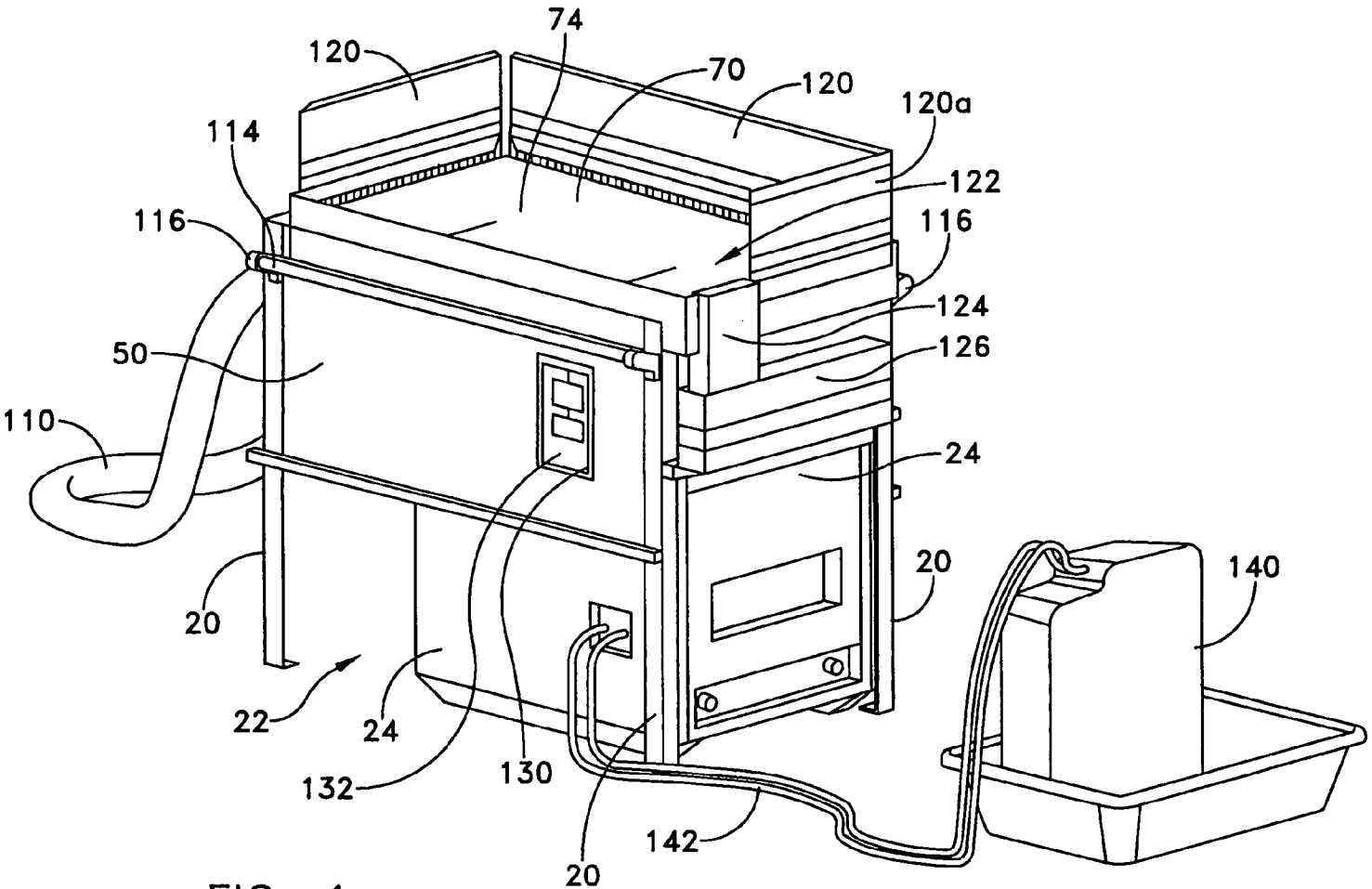
FIG. 1 is a perspective view of one form of stove apparatus illustrative of an embodiment of the invention.
Figure 4:
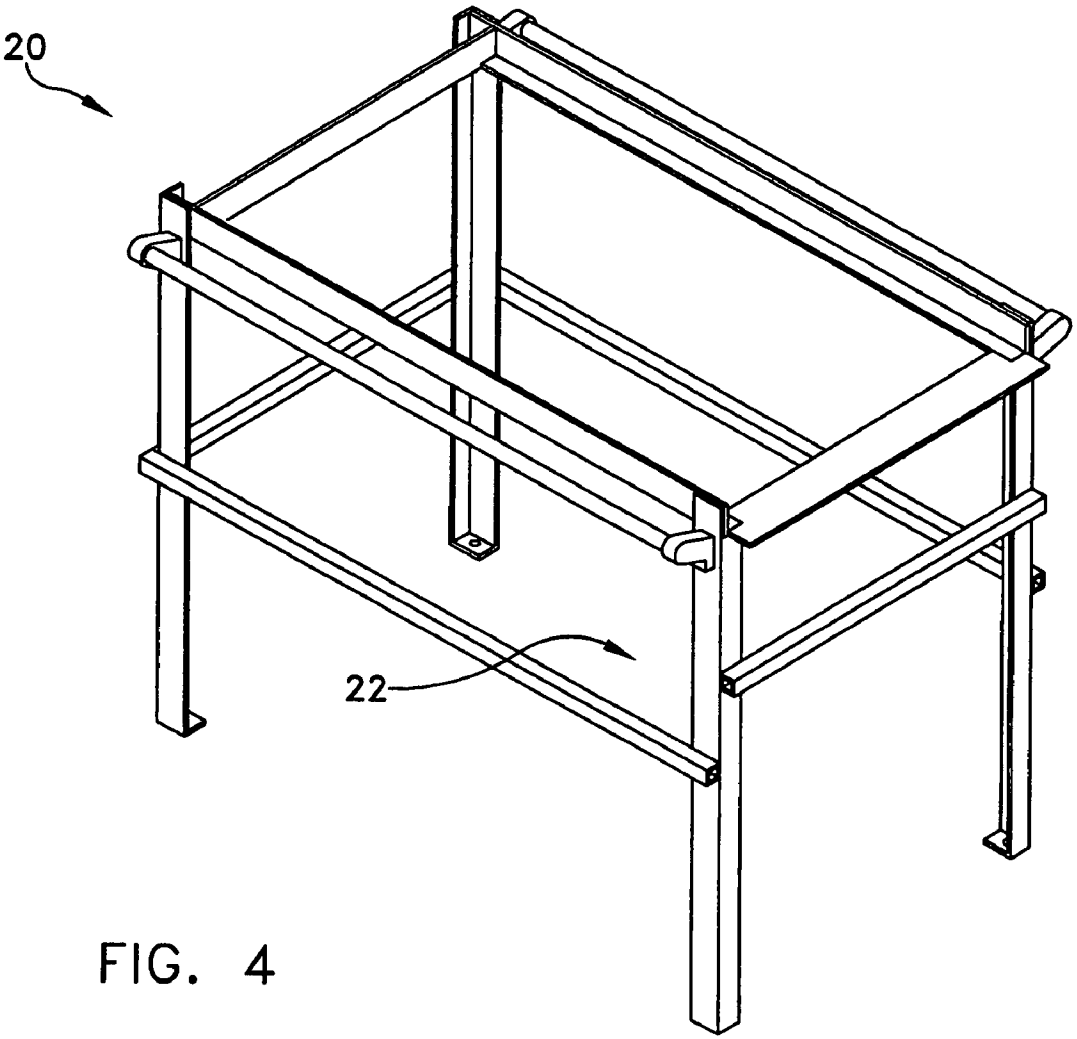
FIG. 4 is a perspective view of a frame portion of the apparatus of FIG. 1.

Referring to FIGS. 1 and 4, it will be seen that an illustrative stove apparatus includes a frame assembly 20 bounding an area 22 at a base thereof, the area 22 being adapted to receive a burner assembly 24 including a burner 26 (FIG. 2) for supporting a flame.

The stove apparatus further includes a heating cavity assembly 30 (FIGS. 2 and 5) mounted on the frame assembly 20 and having four side walls 32, 34, 36 and 38 and a bottom wall 40. The bottom wall 40 is provided with an opening 42 therein (FIG. 5).

Figure 13:
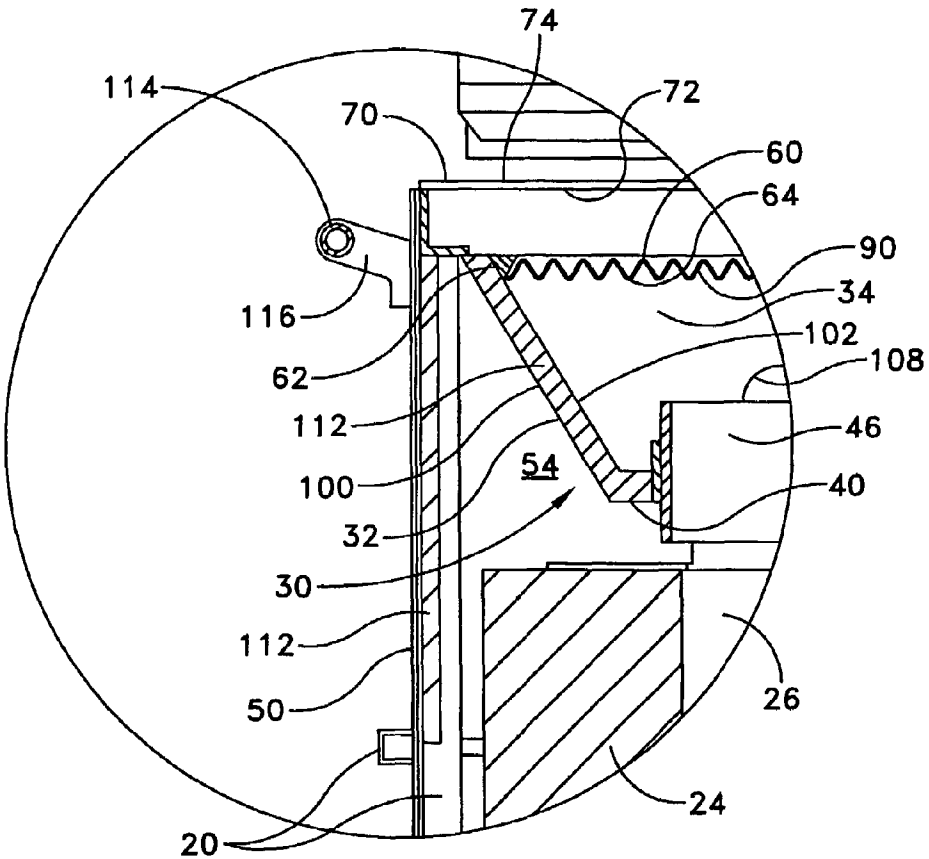
FIG. 13 is an enlarged view of matter in circle A of FIG. 12.
Figure 14:
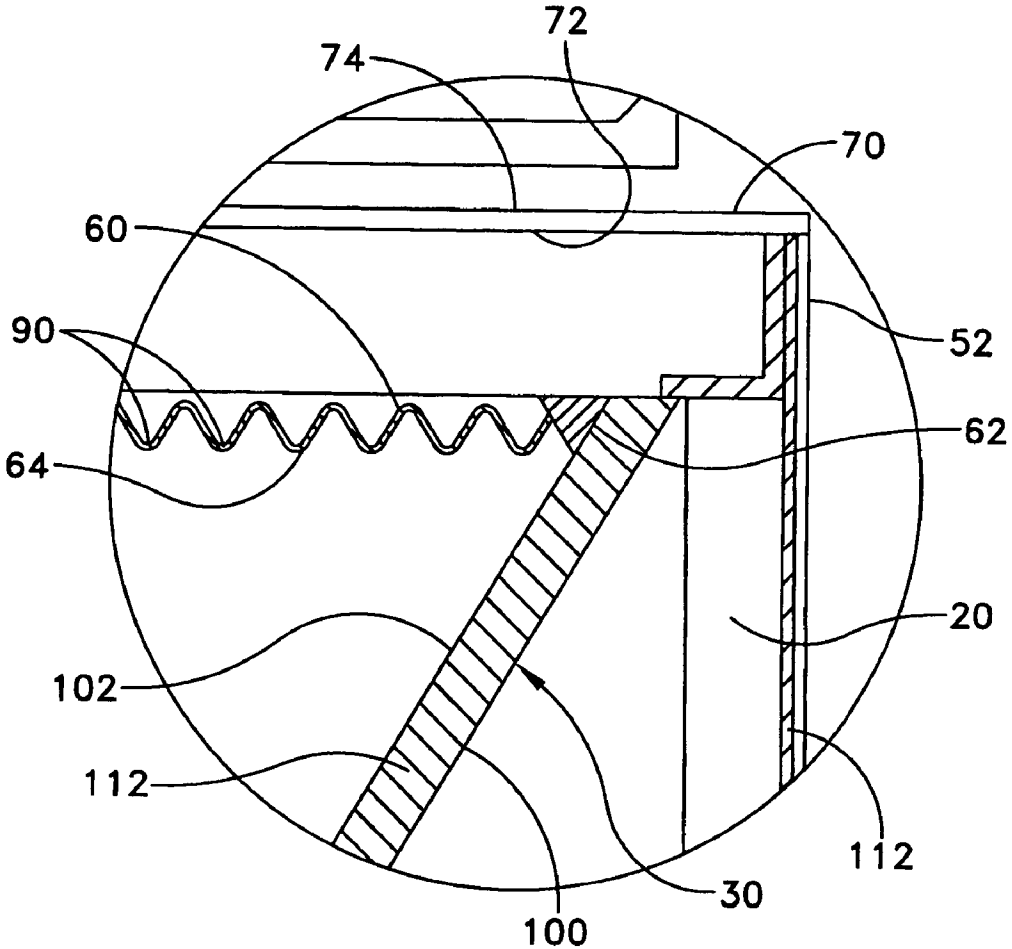
FIG. 14 is an enlarged view of matter in circle B of FIG. 12.

A collar structure 46 (FIGS. 2 and 13) is mounted in the heating cavity assembly 30 around the bottom wall opening 42 and serves to conduct hot gases from the burner 26 up into the interior of the heating cavity assembly.

Figure 3:
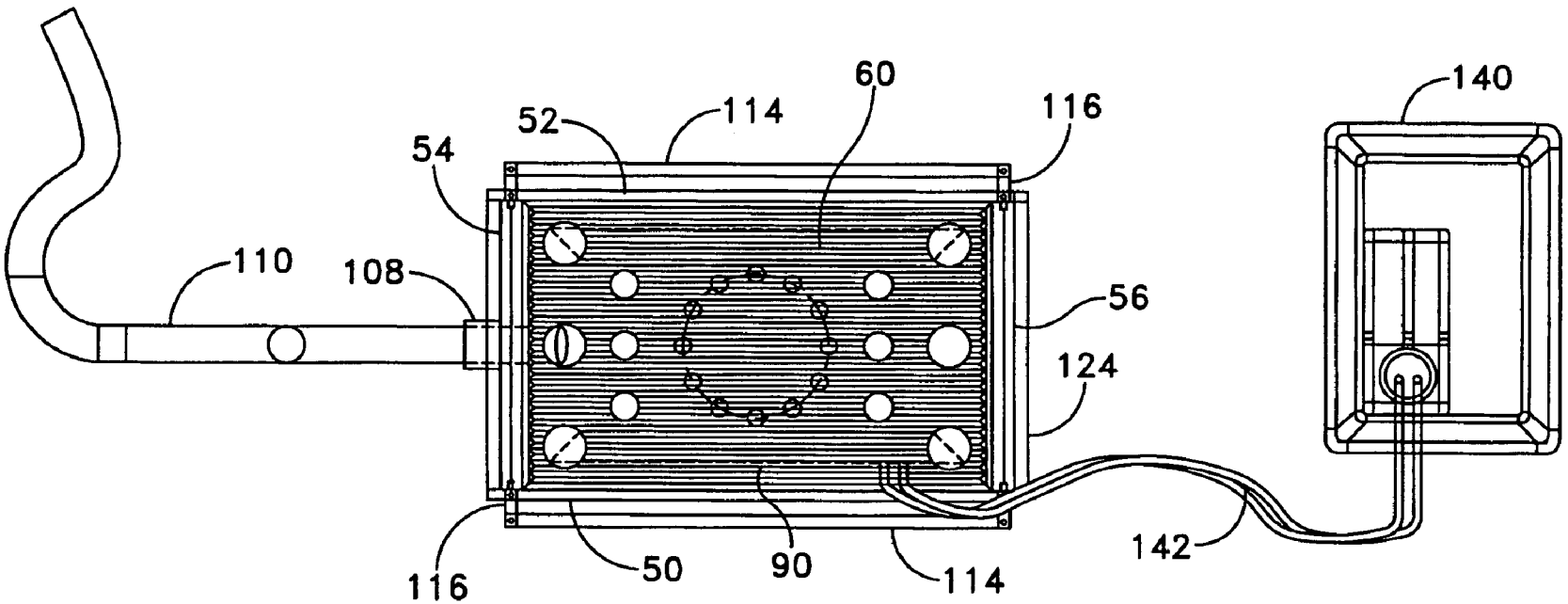
FIG. 3 is a top view of the apparatus of FIG. 1 with a cooking surface removed to show structure therebeneath.

A front panel 50, back panel 52, and side panels 54, 56 are mounted on the frame 20 to enclose the heating cavity assembly 30 (FIG. 3).

Figure 5:
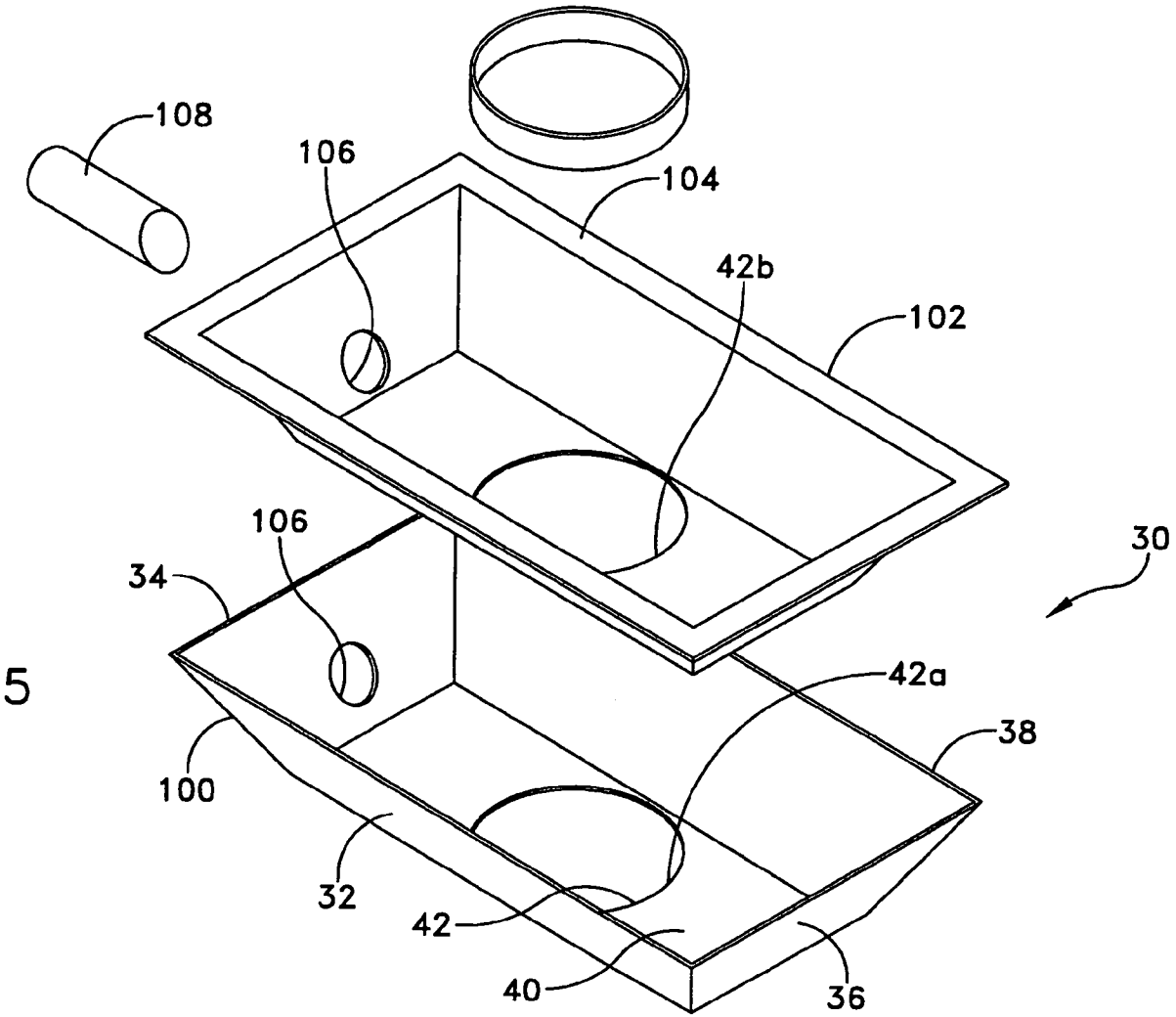
FIG. 5 is an exploded perspective view of portions of the apparatus of FIGS. 1-3.

A diffuser plate 60 (FIGS. 3, 6-8 and 12-14) rests on the otherwise open top of the heating cavity assembly 30, the edges 62 of the diffuser plate 60 being contiguous with, and shaped complementarily to, the side walls 32, 34, 36, 38 of the heating cavity assembly 30 (FIG. 5).

Figure 2:
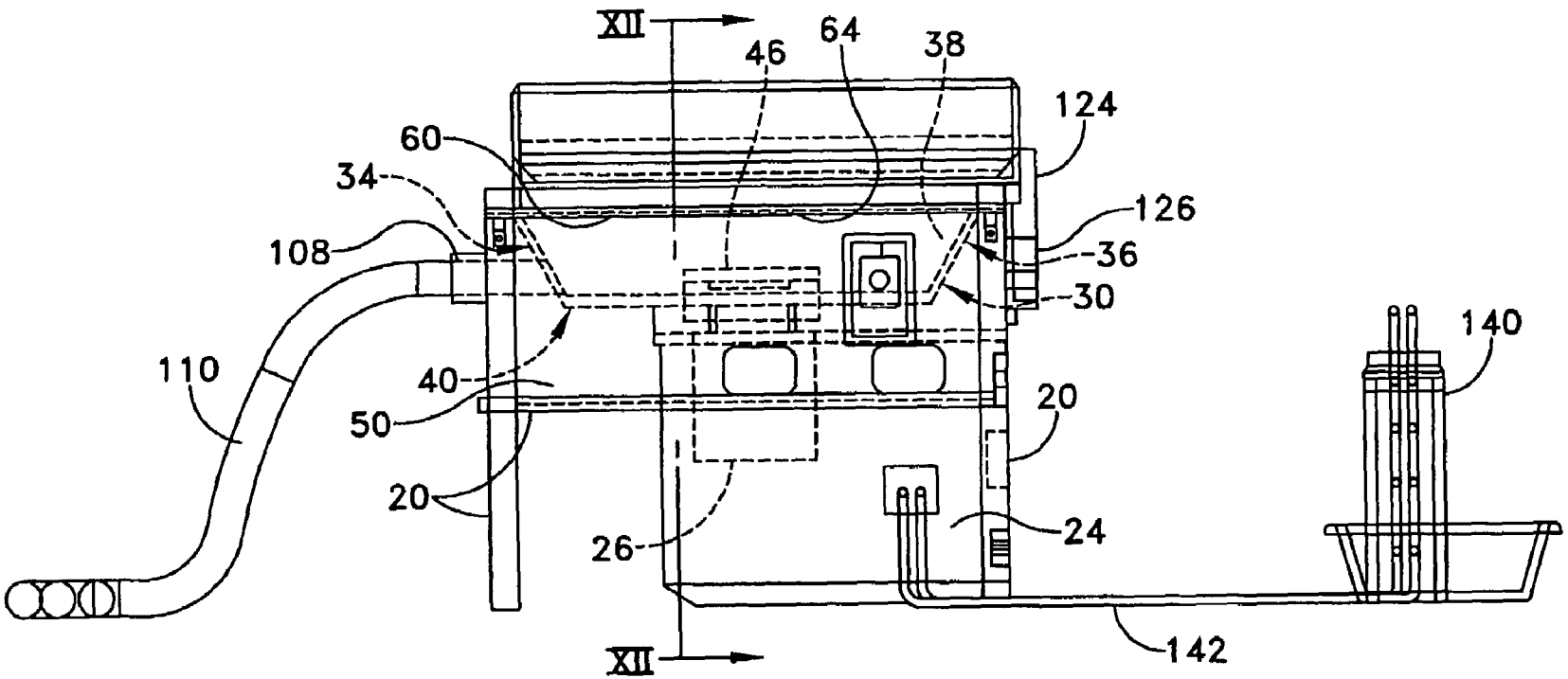
FIG. 2 is a front elevation view of the apparatus of FIG. 1.

As may be seen in FIG. 2, the diffuser plate 60 is disposed over the burner 26 and the collar structure 46. As will be described in more detail hereinbelow, the diffuser plate 60 is configured to distribute the heated gases rising from the burner 26 and the collar structure 46, and impinging upon its underside 64 (FIGS. 2, 13 and 14), evenly therethrough, so as to evenly distribute the heated gases upon the upper surface 66 (FIGS. 7 and 8) of the diffuser plate 60.

A griddle plate 70 (FIGS. 1, 13 and 14) is disposed over the diffuser plate 60 and is spaced from the diffuser plate. An undersurface 72 (FIGS. 13 and 14) of the griddle plate 70 is opposed to the diffuser plate upper surface 66. An upper surface 74 of the griddle plate 70 constitutes the cooking surface of the stove apparatus.

As noted hereinabove, the diffuser plate 60 is configured to permit the passage of heated gases therethrough in such a manner as to distribute the heated gases evenly at the upper surface 66 of the diffuser plate and thereby uniformly heat the undersurface 72 of the griddle plate 70.

Figure 6:
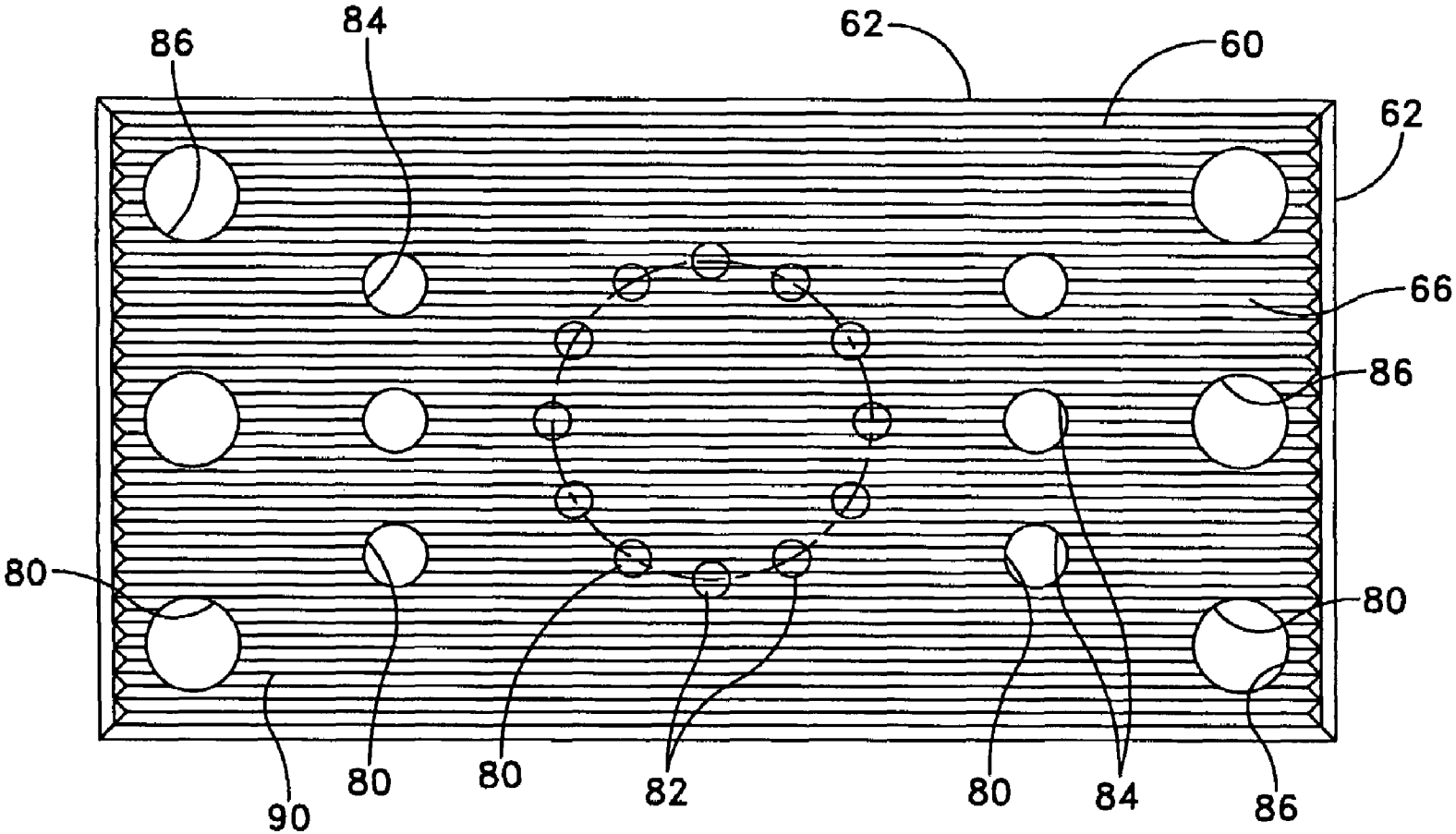
FIG. 6 is a top plan view of a component of the apparatus shown in FIG. 3.
Figure 8:
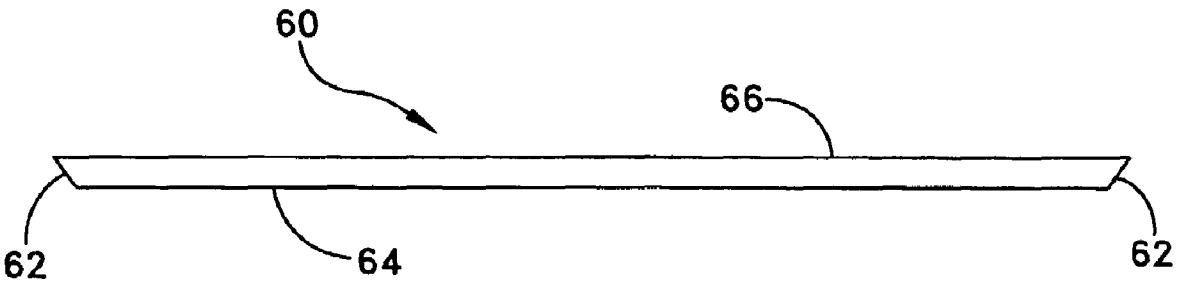
FIG. 8 is a side elevational view of the component of FIG. 6.
Figure 7:
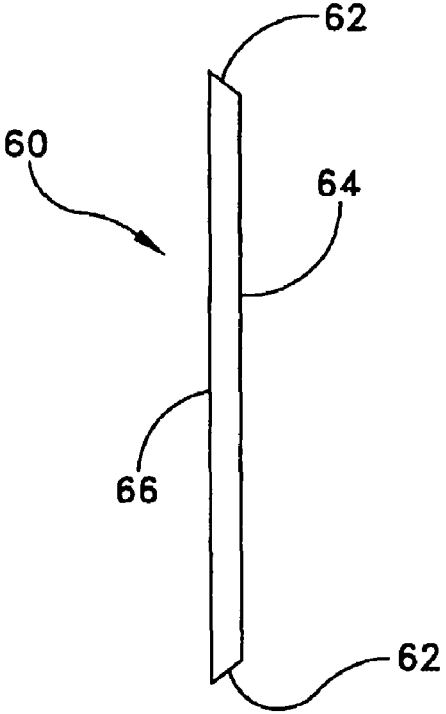
FIG. 7 is an end elevational view of the component of FIG. 6.

Referring to FIG. 6, it will be seen that the diffuser plate 60 is provided with perforations 80 extending therethrough for the flow of the heated gases therethrough. More specifically, the perforations 80 include a series of first perforations 82 near the center portion of the plate 60, and second perforations 84 larger than the first perforations 82 and spaced outwardly therefrom, nearer the ends of the diffuser plate 60.

Preferably, the diffuser plate 60 is provided with third perforations 86 larger than the second perforations 84 and still further removed from the central portion of the plate and nearer than the second perforations to the ends of the plate.

As may be seen in FIG. 6, the upper surface 66 of the diffuser plate 60 is provided with grooves 90 extending throughout the length of the upper surface of the plate, most of the grooves intersecting perforations 80. The perforations 80 may be substantially round holes. The first or inner-most holes 82 may be provided in a circular arrangement, as illustrated in FIG. 6.

In operation, hot gases impinge upon the underside 64 of the diffuser plate 60 at a central portion of the plate. Upon contact with the underside of the diffuser plate, the hot gases in part pass through the first holes 82 and in larger part disperse outwardly from the plate central portion towards the ends of the plate. The relatively small size of the first holes 82 insures that only a relatively small portion of the upflowing gas passes through the first holes and a relatively large portion is directed outwardly.

The outwardly directed gas moves into the regions of the second holes 84, which permit a greater portion of the hot gases to pass therethrough, but still restrict the flow by virtue of the size of the second holes, such that a larger portion of the gases continues moving outwardly and encounters the third holes 86, which are of a size sufficient to permit substantially the large remainder of the gases to flow through the diffuser plate and into the region bounded by the diffuser plate 60 and the griddle plate 70.

The flow of the hot gases lengthwise along the underside 64 of the diffuser plate is accommodated by lengthwise extending grooves 90, most of which intersect various ones of the perforations 80. Thus, the hot gases are channeled along the underside of the diffuser plate, with portions of the gases escaping from the first channels upon coming to a hole in the diffuser plate, more gas escaping upon reaching the second holes, and almost all the remainder of the gas escaping upon reaching the relatively large third holes.

The holes 82, 84, 86 are sized such that the hot air reaching the upper surface 66 of the diffuser plate 60 is in greater quantity, and therefore at a higher pressure, at the ends of the plate, i.e., near the large third holes, than at the center of the plate, i.e., near the small first holes, setting up a flow in the region between the diffuser plate 60 and the griddle plate 70 generally from outward inwardly, contrary to the manner in which griddle plates normally are heated. The result is a substantially even distribution of heat on the upper surface 66 of the diffuser plate 60 and therefore a substantially even distribution of heat on the undersurface 72 of the griddle plate 70, which in turn provides substantially even heating of the upper surface 74, or cooking surface, of the griddle plate 70.

In a preferred embodiment of the invention, the heating cavity assembly 30 includes a heating cavity sleeve 100 (FIG. 5) including the side walls 32, 34, 36 and 38, bottom wall 40 and an opening 42*a*.

A complementarily shaped heating cavity member 102 is provided with an opening 42*b* which is aligned with the opening 42*a* to form the heating cavity assembly opening 42. The heating cavity member 102 is further provided with an open top portion bounded by an outwardly extending flange 104.

The heating cavity sleeve 100 and member 102 are provided with aligned second openings 106 (FIG. 5) adapted to receive a conduit 108 (FIGS. 2, 3 and 5) which, in turn, is adapted for connection to an exhaust hose 110 (FIGS. 1-3). The conduit 108 is disposed proximate the bottom wall of the heating cavity member 102, such that hot gases near the bottom wall of the heating cavity member, that is, gases which do not exit through the diffuser plate 60, are able to escape, or be drawn, from the heating cavity assembly and carried to a remote location.

Insulation 112 (FIGS. 13 and 14) is disposed between the heating cavity sleeve 100 and the heating cavity member 102 and, also, on interior surfaces of the panels 50, 52, 54, 56. The insulation 112 and the removal of unused hot gases from the heating cavity member serve to greatly lessen the otherwise oppressive heat normally ambient around a cooking apparatus.

Figure 11:
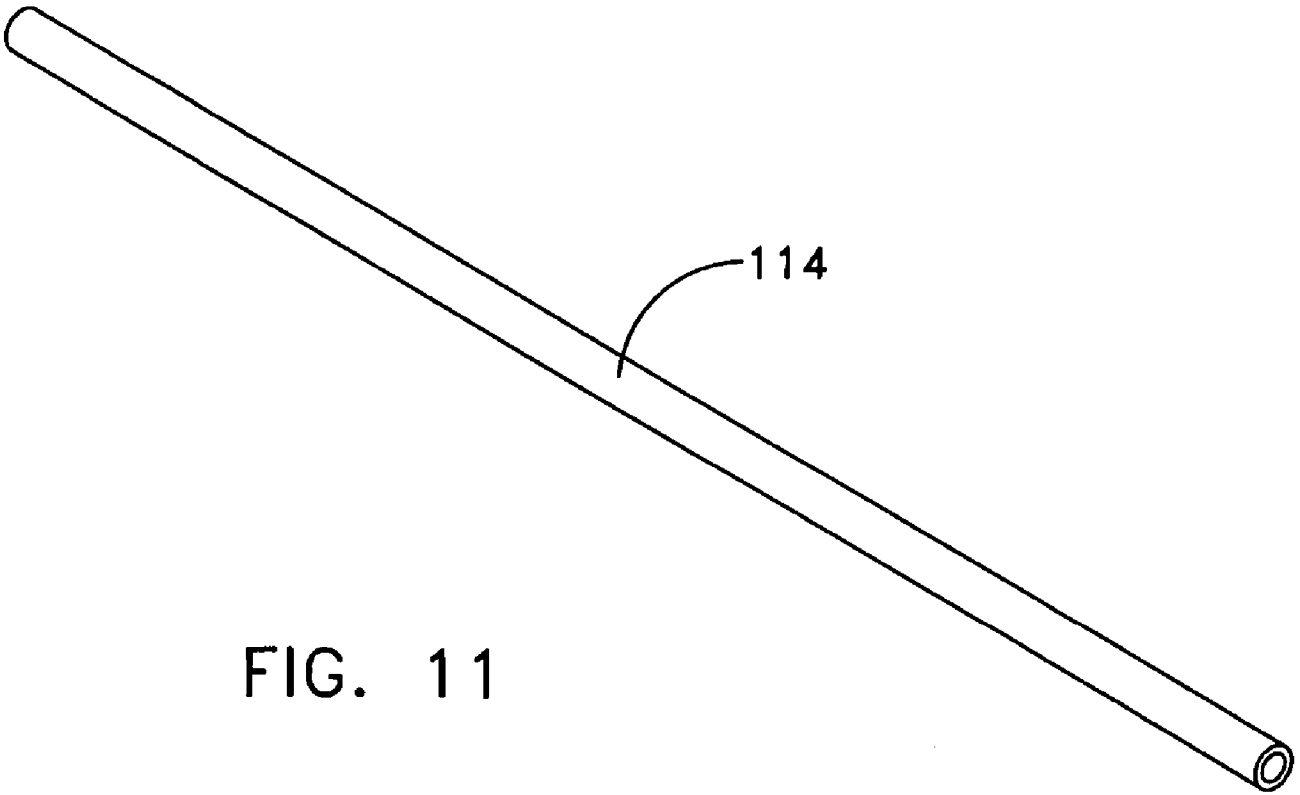
FIG. 11 is a perspective view of a component of the apparatus shown in FIGS. 1 and 3.
Figure 12:
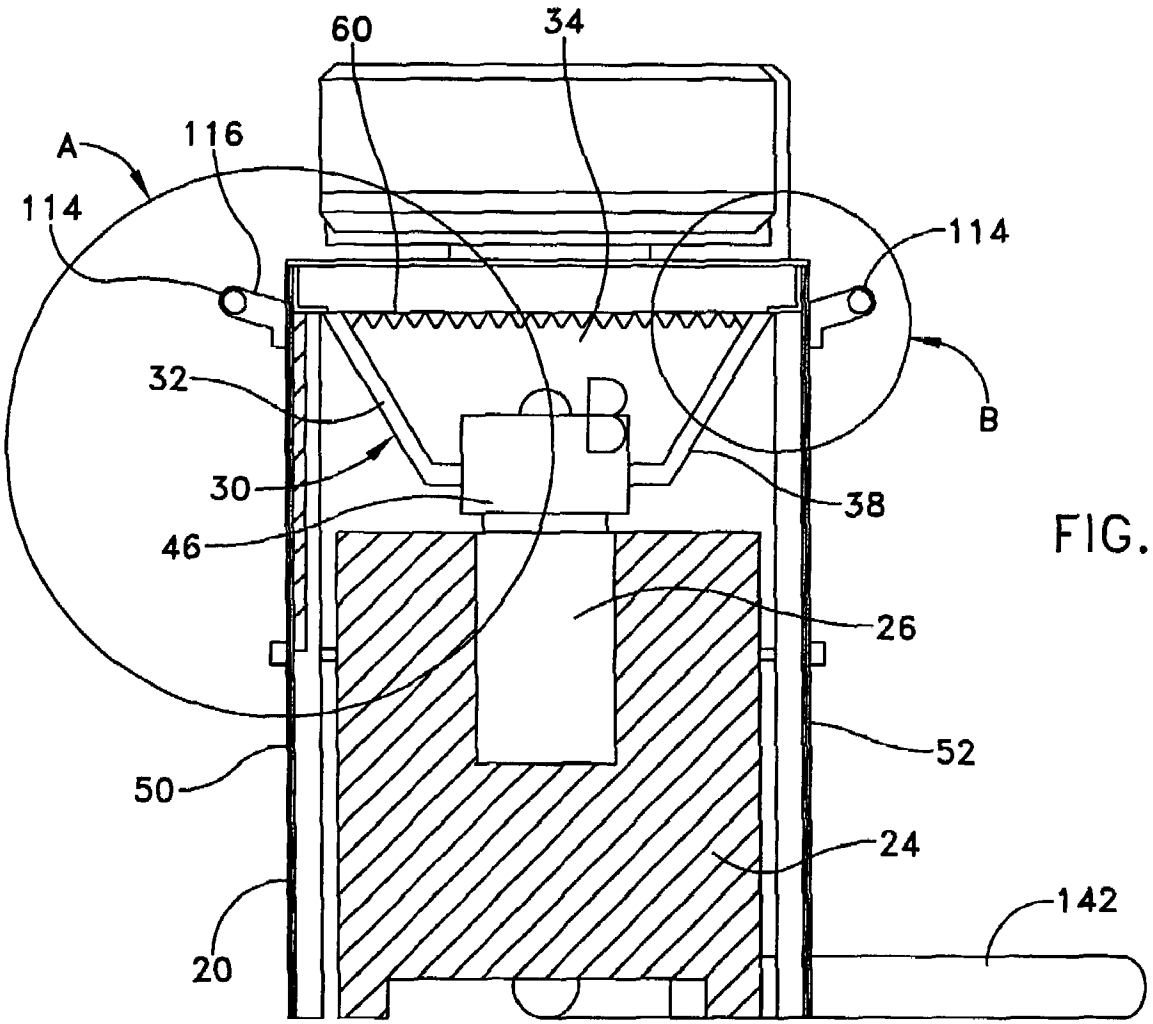
FIG. 12 is a sectional view taken along line XII-XII of FIG. 2.

The apparatus is provided with handrails 114 (FIGS. 1 and 3) supported by handrail supports 116 (FIGS. 1, 3 and 13) attached to portions of the frame assembly 20. The handrail supports 116 retain the handrails 114 spaced from the remainder of the apparatus, such that the handrails 114 are exposed to ambient air all around. Further, the handrails 114 are of tubular construction (FIG. 11), minimizing the amount of handrail material prone to retaining heat.

Referring to FIG. 1, it will be seen that grease guards 120 are mountable on the apparatus at rear and side edges of the griddle plate 70. One of grease guards 120*a* (FIG. 1) is of less length than the corresponding edge of the griddle plate to provide a gap 122 which facilitates the flow of grease off the upper surface 74 of the griddle plate 70.

The apparatus is further provided with a grease funnel 124 mounted thereon for receiving grease flow from the griddle plate cooking surface and directing the flow of grease downwardly. A grease catcher 126 is mounted on the apparatus immediately below the grease funnel 124 for receiving and holding the grease flowed from the cooking surface. The grease catcher 126 acts as a reservoir for accumulated grease and is readily removable from the apparatus and replaced.

Figure 15:
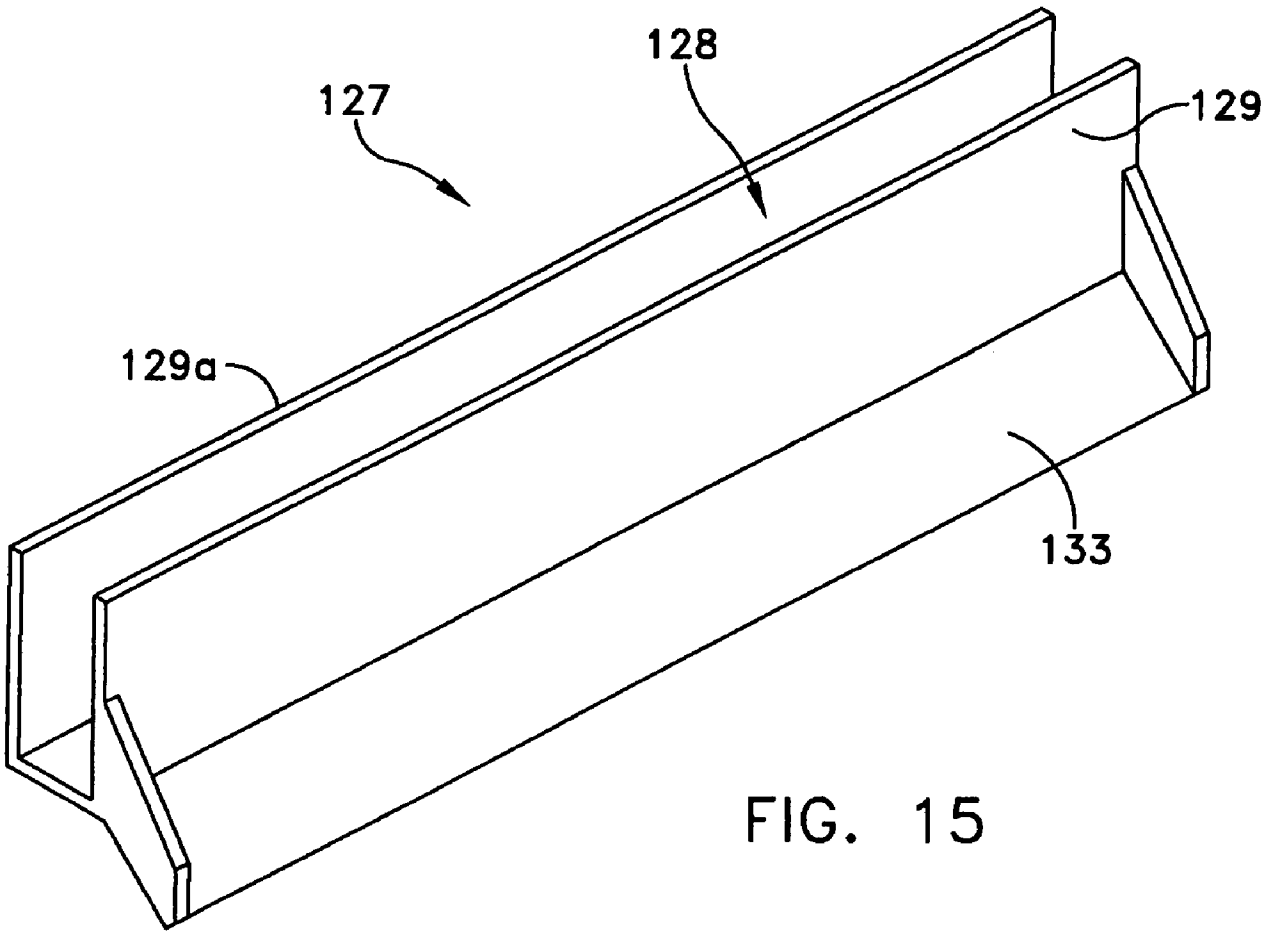
FIG. 15 is a perspective view of a further component of the apparatus.
Figure 16:
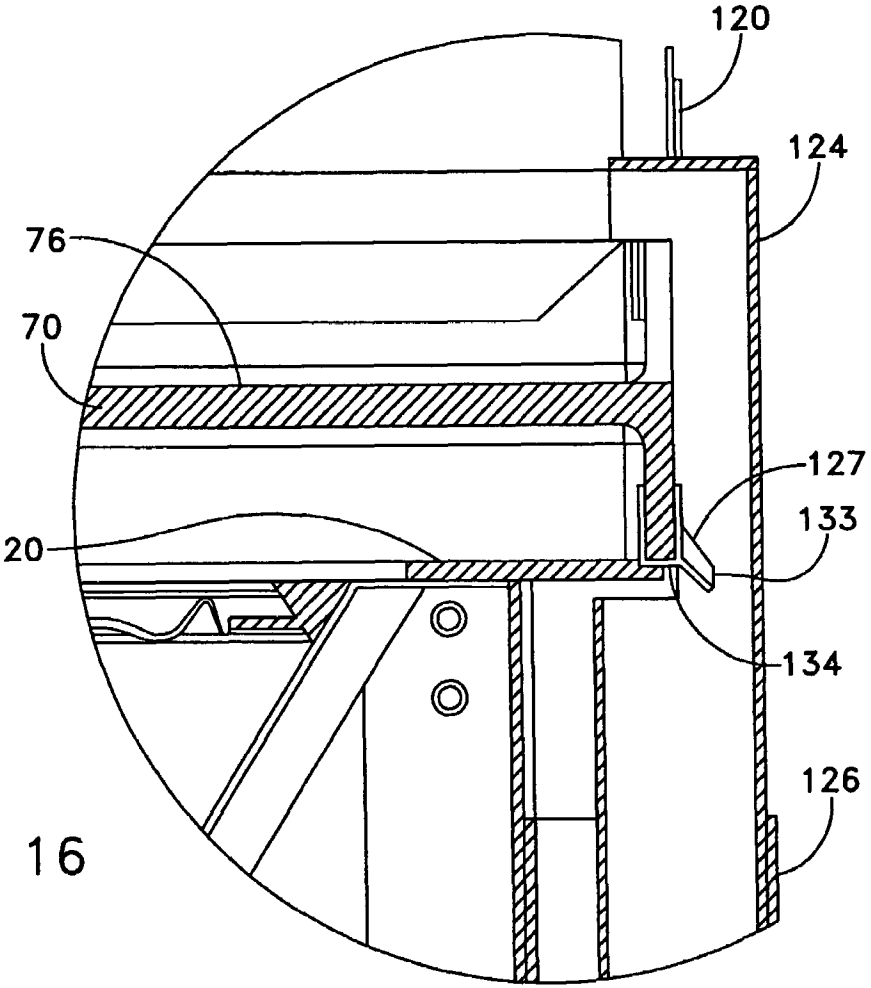
FIG. 16 is a sectional view showing the location of the component of FIG. 15 on the apparatus.

Referring to FIG. 15, it will be seen that a further component of the apparatus comprises a grease deflector 127 defining a groove 128 formed by two parallel walls 129*a* and 129*b*. A deflector plate 133 extends from the wall 129*b* and is angled downwardly therefrom. As shown in FIG. 16, the deflector 127 is mounted on a lower edge portion 134 of the griddle plate 70, the lower edge portion 134 being disposed in the groove 128. The grease flowed from the cooking surface 76 and down through the grease funnel 124 flows over an upper surface of the deflector plate 133, and is directed thereby outwardly in a direction away from the burner assembly 24 so as to remove the free-flowing grease as far as possible from the heat source. The grease funnel 124, catcher 126, and deflector 127 serve to prevent the "wicking", that is, the uncontrolled flow of hot grease, exhibited by prior cooking apparatuses.

Figure 9:
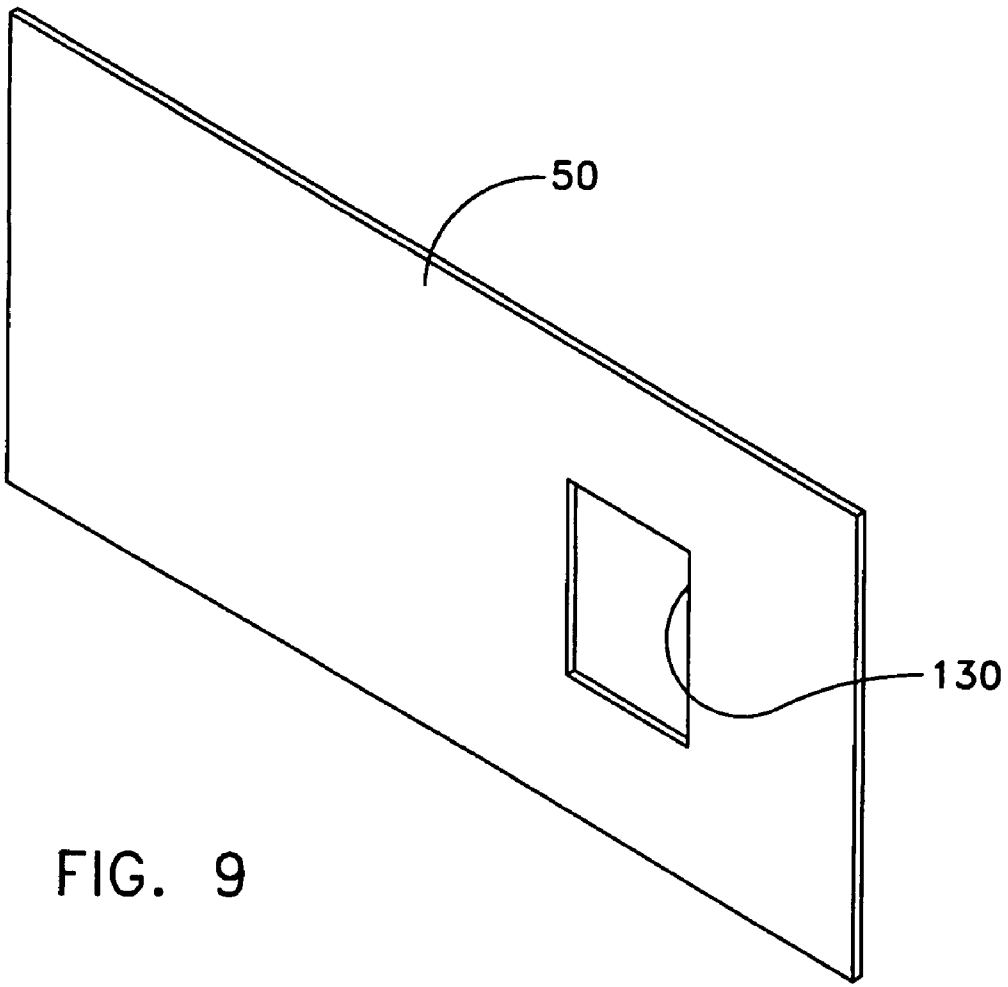
FIG. 9 is a perspective view of a component of the apparatus shown in FIG. 1.
Figure 10:
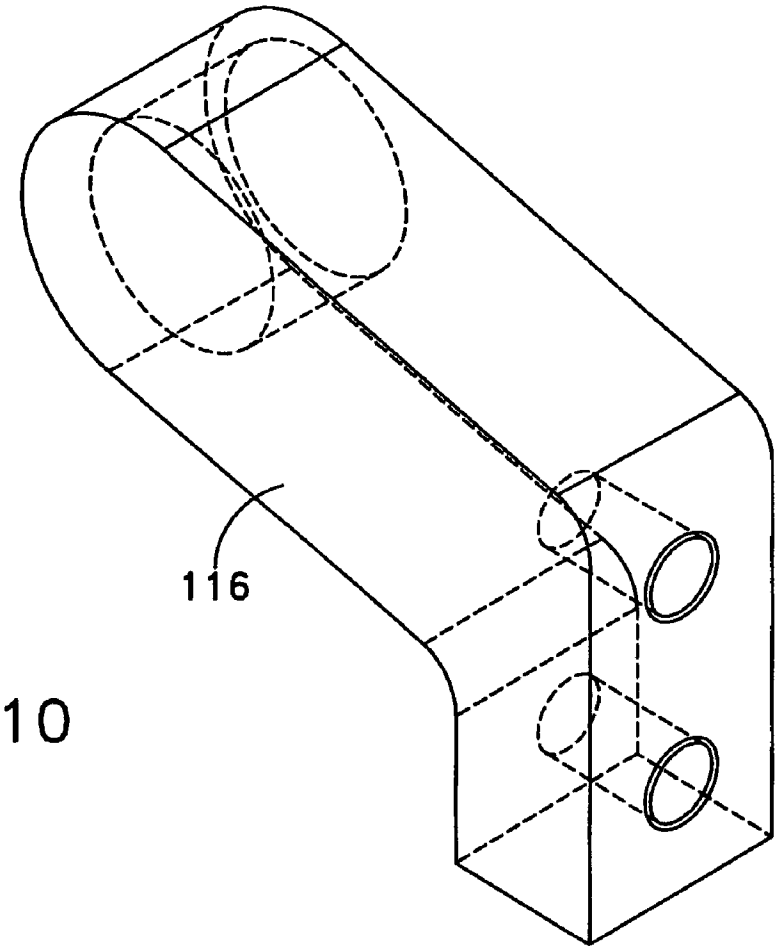
FIG. 10 is a perspective view of a component of the apparatus shown in FIGS. 1 and 3.

As shown in FIGS. 1 and 9, the front panel 50 is provided with a window 130 in which is mounted a thermostatic controller 132. The controller 132 includes a temperature detection means (not shown) for tracking the temperature within the heating cavity member 102. The controller 132 serves to control the intensity of the burner flame to maintain the temperature within the heating cavity member proximate a selected level.

The burner assembly 24 may be selected to operate on a selected fuel as, for example, diesel fuel. A five gallon fuel can 140 may be used to supply fuel through a fuel hose 142 connectable to the burner assembly 24 to provide fuel to the burner in accordance with signals from the thermostatic controller 132. A desired temperature may be indicated by an operator by manipulation of the thermostatic controller 132 at the front of the apparatus.

Accordingly, there is provided a stove apparatus suitable for field use and having a cooking surface which is of substantially the same temperature throughout the area thereof, enabling substantially simultaneous and equal degree of cooking of large numbers of food products. The stove apparatus is therefore adapted to produce cooked foods for larger numbers of people in a relatively short time.

The stove apparatus described hereinabove is further more comfortable for the cooks and enables the cooks to remain close to the stove. The layers of insulation and the removal of hot gases from the heating cavity member, provides for a cooler ambient temperature in the vicinity around the stove.

If it becomes necessary to move the stove in the course of its use, the lower ambient temperature of the outer surface of the stove and the mechanical mounting and construction of the handrails permits manual movement of the stove even during operation of the stove.

The stove apparatus described hereinabove further protects the cooks from grease burns caused by wicking, and greatly diminishes the production of overly greasy foods by facilitating grease run-off and collection.

The above-described stove apparatus is further adapted to receive burner assemblies of various types and using various fuels. The apparatus further permits exchanges of fuel-containing units, such as 5 gallon liquid fuel cans, without disabling the apparatus.

The stove apparatus describe hereinabove still further permits elective modification of the cooking surface temperature by provision of a thermostatic control which is operated to control the flow of fuel to the burner to influence the intensity of the burner flame, to thereby influence the temperature of the flowed hot gases, and thereby, because of the diffuser plate, to influence the temperature of substantially the entirety of the griddle plate cooking surface.

Finally, the apparatus is configured such that two of the hottest components, the heating cavity member and the diffuser plate, which are contiguous to each other, are slidably disposed relative to each other, such that expansion of either or both members by heat results only in the two members sliding relative to each other, rather than jamming against each other.

It is to be understood that the present invention is by no means limited to the particular construction herein disclosed and/or shown in the drawings, but also comprises any modification or equivalent within the scope of the claims.

What is claimed is:

1. A stove apparatus comprising:

a frame assembly bounding an area at a base thereof adapted to receive a burner assembly comprising a burner for supporting a flame, said burner assembly for operating on liquid fuel, and said flame being generated from the liquid fuel;

a heating cavity assembly mounted on said frame assembly and having an interior, and four side walls, and a bottom wall having an opening therein;

a collar structure mounted in said heating cavity assembly around the bottom wall opening and upstanding from the bottom wall said collar for conducting hot gases from the burner into the interior of the heating cavity assembly;

front, rear, first and second side panels mounted on said frame assembly to enclose the side walls of said heating cavity assembly, further comprising a thermostatic controller mounted in a selected one of said panels, said controller comprising temperature detection means for tracking the temperature within said heating cavity member and for controlling the intensity of the burner flame to maintain the temperature within the heating cavity member proximate a selected level;

a diffuser plate mounted on said heating cavity assembly and covering an open top portion thereof, said diffuser plate having an underside and an upper surface, said diffuser plate being contiguous with, and shaped complimentarily to the four side walls of the heating cavity assembly, said diffuser plate being disposed over the burner and the collar structure, said diffuser plate having perforations extending therethrough for passage therethrough of heated gases rising from the burner, said diffuser plate having grooves extending substantially from a first end to a second end of said diffuser plate, and at least a portion of the grooves intersect at least a portion of said perforations, said perforations comprising first perforations proximate a center portion of said diffuser plate, second perforations larger than said first perforations nearer the ends of said diffuser plate, and third perforations larger than said second perforations and disposed nearer than said second perforations to the ends of said diffuser plate; and wherein said diffuser plate is configured to receive the heated gases rising from the burner and through the collar structure and impinging on the underside of the diffuser plate at a central portion of the plate; upon contact with the underside of the diffuser plate, the heated gases in part pass through said first perforations and in larger part disperse outwardly from said central portion of the plate toward the first end and the second end of the plate;

said outwardly dispersed heated gases passing through the second perforations, in a greater portion than the heated gases passing through the first perforations;

the heated gases continuing to disperse outwardly toward the first end and the second end of the plate and passing through the third perforations in a greater portion than the heated gases passing through the second perforations; whereby the heated gases are dispersed along the underside of the diffuser plate by the grooves and through the perforations for distributing the gases substantially evenly proximate the upper surface of the diffuser plate; and a griddle plate mounted above said diffuser plate and spaced therefrom, and having an undersurface opposed to the diffuser plate upper surface, and having an upper surface for cooking operations; and wherein the first, second and third perforations are sized such that the heated gases reaching the upper surface of the diffuser plate are in a region between the upper surface of the diffuser plate and undersurface of the griddle plate, and the heated gases are in greater quantity and higher pressure at the first end and at the second end of the diffuser plate than at the center of the plate;

whereby the heated gases flow, in the region between the upper surface of the diffuser plate and the undersurface of the griddle plate, from outward of the griddle plate inward toward a center of the griddle plate for evenly heating the undersurface of the griddle plate and for having a substantially even heat across the upper surface of the griddle plate.

2. The stove assembly in accordance with claim 1 wherein said first perforations are disposed in a circle about a central portion of said diffuser plate.

3. The stove assembly in accordance with claim 1 wherein said perforations comprise substantially round holes.

4. The stove apparatus in accordance with claim 1 wherein said heating cavity assembly includes a second opening, and further comprises a conduit disposed in the second opening and adapted to receive an exhaust hose.

5. The stove apparatus in accordance with claim 4 wherein the second opening is disposed proximate the bottom wall of said heating cavity assembly, such that heated gases proximate the bottom wall of said heating cavity assembly are enabled to flow from said heating cavity assembly and through the conduit and hose to a remote location.

6. The stove apparatus in accordance with claim 4 wherein said conduit extends into said heating cavity assembly and is disposed proximate the bottom wall of said heating cavity assembly.

7. The stove apparatus in accordance with claim 1 wherein insulation is disposed on interior surfaces of said panels, and said apparatus further comprises handrails mounted on frame portions supporting said front and rear panels of the apparatus, said handrails being spaced from the respective front and rear panels, and said heating cavity assembly having escape structure facilitating the removal of hot gases remote from said griddle plate from said heating cavity assembly, whereby said handrails are substantially insulated from heat sources and are adapted thereby to remain cool for manual handling.

8. The stove apparatus in accordance with claim 7 wherein said handrails are tubular.

9. The stove apparatus in accordance with claim 7 wherein the apparatus comprises a pair of handrail supports attached to portions of the frame the pair of handrail supports retaining one of said handrails in positions spaced from the respective front and rear panels.

10. The stove apparatus in accordance with claim 1 and further comprising grease guards mountable on said frame and upstanding from rear and side edges of said griddle plate, a selected one of said grease guards being of less length than a corresponding edge of said griddle plate to provide a gap, such that grease on the upper surface of said griddle plate is flowable therethrough;

said apparatus further comprising a grease funnel mounted thereon and extending from the gap downwardly; and a grease catcher in communication with said funnel to receive grease flowed from the upper surface of said griddle plate.

11. The stove apparatus in accordance with claim 10 wherein said grease catcher provides a reservoir for accumulation of grease.

12. The stove apparatus in accordance with claim 11 wherein said grease catcher is removable and replaceable.

13. The stove apparatus in accordance with claim 1 and further comprising the burner assembly, said burner assembly being positionable within the area at the base of said frame, and having a burner alignable with said heating cavity collar structure.

14. The stove apparatus in accordance with claim 1 wherein the apparatus further comprises a thermostatic controller mounted in a selected one of side panels, said controller for tracking the temperature within said heating cavity assembly and for controlling the intensity of the burner flame to maintain the temperature within the heating cavity assembly proximate a selected level.

15. The stove apparatus in accordance with claim 1 and further comprising the burner assembly, said burner assembly being positionable within the area at the base of said frame, and having a burner alignable with said collar structure.

16. The stove apparatus in accordance with claim 1 wherein the side walls of said heating cavity assembly are inclined outwardly from the bottom wall thereof toward side wall upper edges; and side edges of said diffuser plate are slanted complimentarily to the inclination of the heating cavity assembly side walls and are disposed contiguous to the heating cavity assembly side walls, such that the relative moment therebetween occurs upon expansion of at least one of said heating cavity assembly side walls and said diffuser plate side edges.

17. The stove apparatus in accordance with claim 1 wherein said liquid fuel is diesel fuel.

* * * * *